US006739711B2

(12) United States Patent
Lee et al.

(10) Patent No.: US 6,739,711 B2
(45) Date of Patent: May 25, 2004

(54) INK CARTRIDGE

(75) Inventors: Young-su Lee, Gyeonggi-do (KR); Jeong-seon Kim, Gyeonggi-do (KR); O-hyun Baek, Seoul (KR); Jae-cheol Lee, Gyeonggi-do (KR); Moo-youl Kim, Seoul (KR); Sik-sun Choi, Gyeonggi-do (KR); Jong-suk Seo, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/135,868

(22) Filed: May 1, 2002

(65) Prior Publication Data

US 2003/0058315 A1 Mar. 27, 2003

(30) Foreign Application Priority Data

Sep. 27, 2001 (KR) ..... 2001-60129

(51) Int. Cl.[7] ..... B41J 2/175
(52) U.S. Cl. ..... 347/87; 347/86
(58) Field of Search ..... 347/85, 86, 87

(56) References Cited

U.S. PATENT DOCUMENTS 5,917,525 A * 6/1999 Butty ..... 347/86
5,953,030 A * 9/1999 Ishinaga et al. ..... 347/86
6,086,193 A 7/2000 Shimada et al.
6,302,534 B1 * 10/2001 Tsukahara et al. ..... 347/86

FOREIGN PATENT DOCUMENTS

JP 08090783 A * 4/1996 ..... B41J/2/175
JP 10-166606 6/1998
JP 10-235887 9/1998

OTHER PUBLICATIONS

Copy of Korean Office Action dated Jun. 21, 2003.

* cited by examiner

*Primary Examiner*—Anh T.N. Vo
(74) *Attorney, Agent, or Firm*—Staas & Halsey LLP

(57) ABSTRACT

An ink cartridge including an ink storage chamber in which ink is stored, a cover to cover the upper portion of the ink storage chamber and a head to eject ink droplets in the ink storage chamber onto a recording medium, wherein the cover includes an inner cover to cover the upper portion of the ink storage chamber and an outer cover that seals the ink storage chamber and the inner cover, and is positioned at a predetermined distance above the inner cover. Also provided are plates to form zigzag air passages by blocking a space between the inner cover and the outer cover. With the ink cartridge according to the present invention, it is possible to satisfactorily suppress the backward flow of ink contained in an ink storage chamber due to overheating of or careless treatment of the ink cartridge. Even if ink flows backward from the ink storage chamber, it is stored in an ink storage space, thus preventing the clogging of an air passage. Further, air entering the ink storage space is filtered, passing through the air passage, and additional components are not required to seal up an opening to which ink is supplied. For this reason, manufacturing costs can be reduced and a manufacturing process can be simplified.

16 Claims, 4 Drawing Sheets

INK CARTRIDGE

CROSS-REFERENCE TO RELATED APPLICATIONS

This application claims the benefit of Korean Application No. 2001-60129, filed Sep. 27, 2001, in the Korean Industrial Property Office, the disclosure of which is incorporated herein by reference.

BACKGROUND OF THE INVENTION

1. Field of the Invention

The present invention relates to an ink cartridge that is used in an ink jet printer, and more particularly, to an ink cartridge in which zigzag air passages are formed at the top of an ink storage chamber, thus preventing the air passages from being clogged due to the backward flow of the ink in the ink storage chamber.

2. Description of the Related Art

FIG. 1 is a plan view of a lid 120 of a colored ink cartridge having five chambers disclosed in U.S. Patent No. 6,086,193. Referring to FIG. 1, the ink cartridge includes five ink chambers: two chambers, which are different from each other in terms of ink concentration, are for each of magenta ink and cyan ink, and one chamber for yellow ink. In the lid 120, five ink filling holes 130 and five air discharging holes 132 are formed to correspond to the five ink storage chambers positioned at the bottom of the lid 120. Also, snake grooves 133 are formed extending in a labyrinth fashion from the air discharging holes 132 to air vents 134*a* through 134*e*. Due to the elongated grooves 133, the ink contained in the ink storage chamber can be prevented from evaporating when the inside of each of the ink storage chambers is exposed to the air by taking off a film 135 covering the air vents 134*a* through 134*e* so as to use the ink cartridge.

However, in the case of the ink cartridge having the lid 120 with the grooves 133, air passages are easily clogged when the ink cartridge is turned upside-down by mistake or when the ink stored in the ink storage chambers flows backwards via the grooves 133 when the ink cartridge is shaken or overheated. The clogging of the grooves 133 makes it difficult to ventilate the ink cartridge, which results in irregularity in the pressure inside the ink cartridge. As a result, the pressure inside the ink cartridge becomes lower than it should be for stable operation and thus the ink stored in the ink storage chambers is difficult to be ejected.

SUMMARY OF THE INVENTION

Accordingly, it is an object of the present invention to provide an ink cartridge of which air passages, which are located at the top of each of ink storage chambers, are not clogged due to the backward flow of ink stored in the ink storage chambers.

Additional objects and advantages of the invention will be set forth in part in the description which follows and, in part, will be obvious from the description, or may be learned by practice of the invention.

The foregoing and other objects of the present invention are achieved by providing an ink cartridge including an ink storage chamber in which ink is stored, a cover to cover the upper portion of the ink storage chamber and a head to eject ink droplets in the ink storage chamber onto a recording medium, wherein the cover includes an inner cover to cover the upper portion of the ink storage chamber; an outer cover that seals the ink storage chamber and the inner cover, and is positioned at a predetermined distance above the inner cover; and plates to form zigzag air passages by blocking a space between the inner cover and the outer cover.

The inner cover includes air discharging holes connected to the air passages at its upper portion, and air filling holes through which ink is supplied to the ink storage chamber.

The ink cartridge further includes a cylindrical element that extends from the lower part of the inner cover and has a predetermined height.

Further, each of the ink filling holes is sealed by combining a first cylindrical element, which is formed on the inner cover encircling the opening, and a second cylindrical element formed on the outer cover to be engaged with the first cylindrical element.

Further, the inner cover and the outer cover are ultrasonically fused to be combined with each other.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE INVENTION

Figure 1:
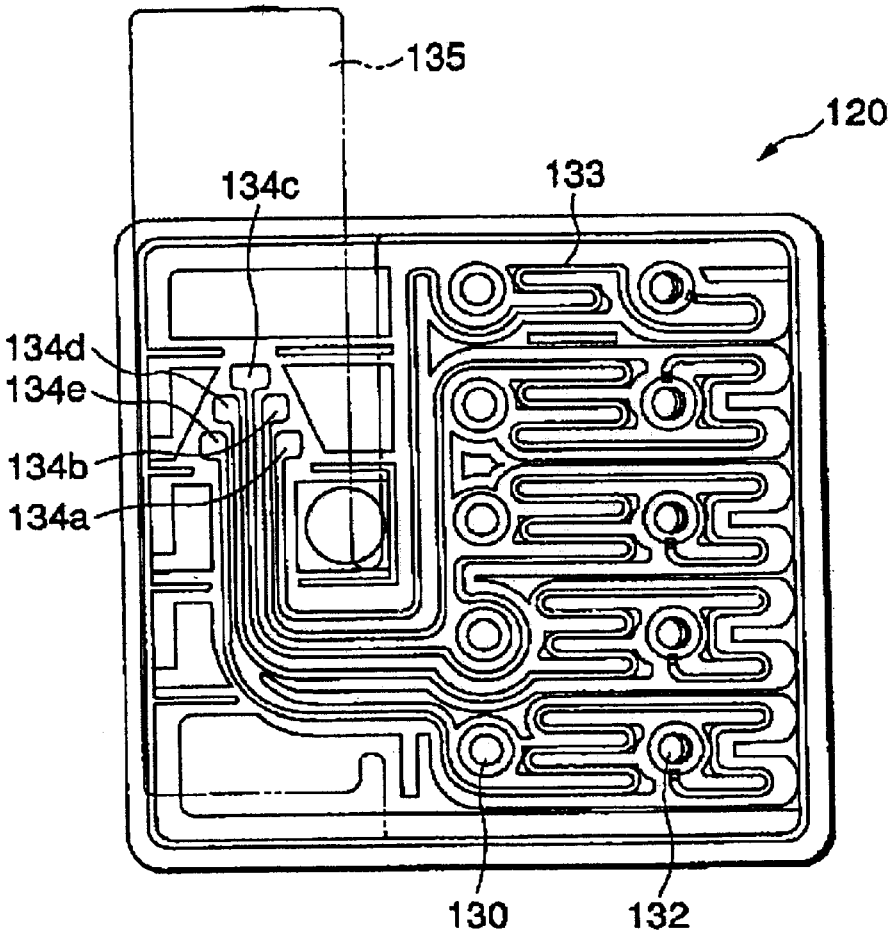
FIG. 1 (PRIOR ART)
FIG. 1 is a plan view of a lid of a conventional ink cartridge.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
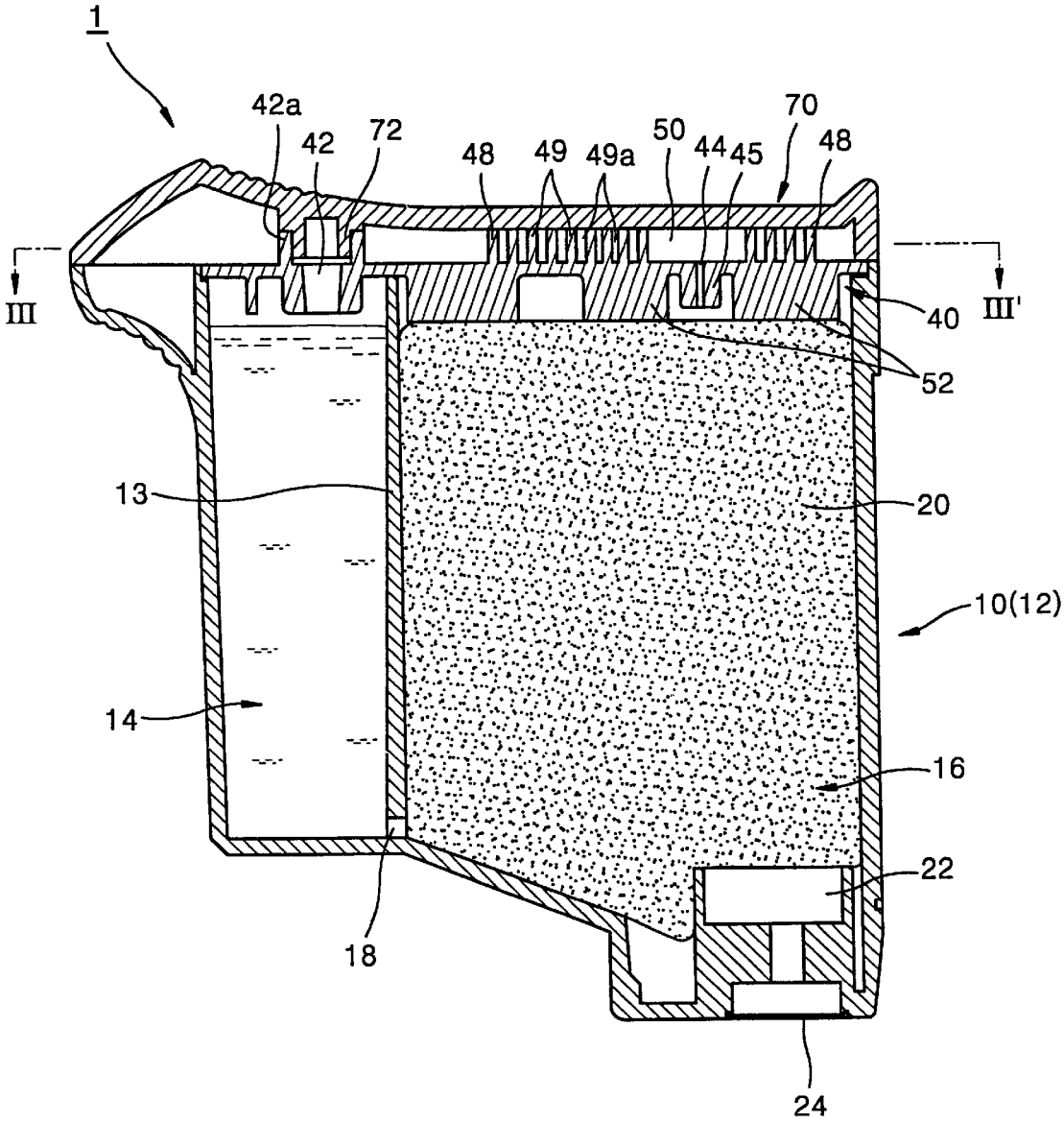
FIG. 2 is a side cross-sectional view of an ink cartridge according to an embodiment of the present invention.
Figure 3:
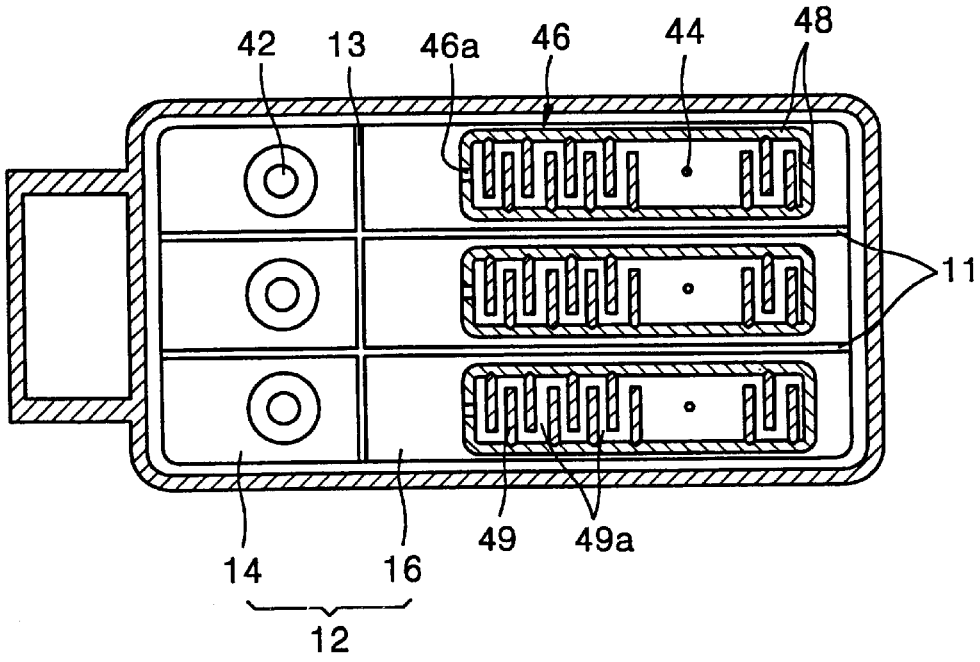
FIG. 3 is a plan view of the ink cartridge of FIG. 2, taken along the line III–III'.

FIG. 2 is a side cross-sectional view of an ink cartridge 1 according to an embodiment of the present invention, and FIG. 3 is a plan view of the ink cartridge of FIG. 2, taken along the line III–III'.

Referring to FIGS. 2 and 3, the ink cartridge 1 includes an ink storage chamber 10; an inner cover 40 to cover the upper portion of the ink storage chamber 10; and an outer cover 70 to seal up the ink storage chamber 10 and the inner cover 40, being located at a predetermined distance from the top of the inner cover 40.

The ink storage chamber 10 is partitioned into three ink storage chambers 12 which contain yellow, magenta and cyan ink, respectively, by two first partition walls 11. Each of the ink storage chambers 12 is divided into first and second chambers 14 and 16 by a second partition wall 13 that is formed perpendicular to the first partition walls 11. An ink passage 18 between the two chambers 14 and 16 is formed at the bottom of the second partition wall 13. The first chamber 14 is filled with ink and the second chamber 16 is filled with ink and a sponge 20. Also, at the bottom of the second chamber 16 is formed an ink supply pipe 22 that supplies ink to a head 24.

In the inner cover 40, an ink filling hole 42 through which ink is supplied to the first chamber 14 and an air discharging hole 44 through which air is ventilated from the second chamber 16 are formed to correspond to each of the ink storage chambers 12. An air chamber 46 is formed by an outer plate 48 stopping up a space between the inner cover 40 and the outer cover 70. In the air chamber 46, zigzag air passages 49*a* are formed by plates 49 arranged in the air chamber 46 between the inner cover 40 and the outer cover 70. However, the plates 49 are not formed around the air discharging hole 44, which is positioned at the bottom of the air chamber 46. Instead, an ink storage space of a predetermined area is formed around the air discharging hole 44. A hole 46*a* through which air goes in is formed on each of the outer plates 48.

A rib 52 is formed below the inner cover 40 to compress the sponge 20 positioned below the rib 52. Also, a cylindrical element 45 is formed to a predetermined height below the plate of the inner cover 40, encircling the air discharging hole 44.

The ink filling hole 42 is doubly sealed both by cylindrical elements 72 and 42*a,* which extend from the outer cover 70 and the inner cover 40, respectively.

Figure 4:
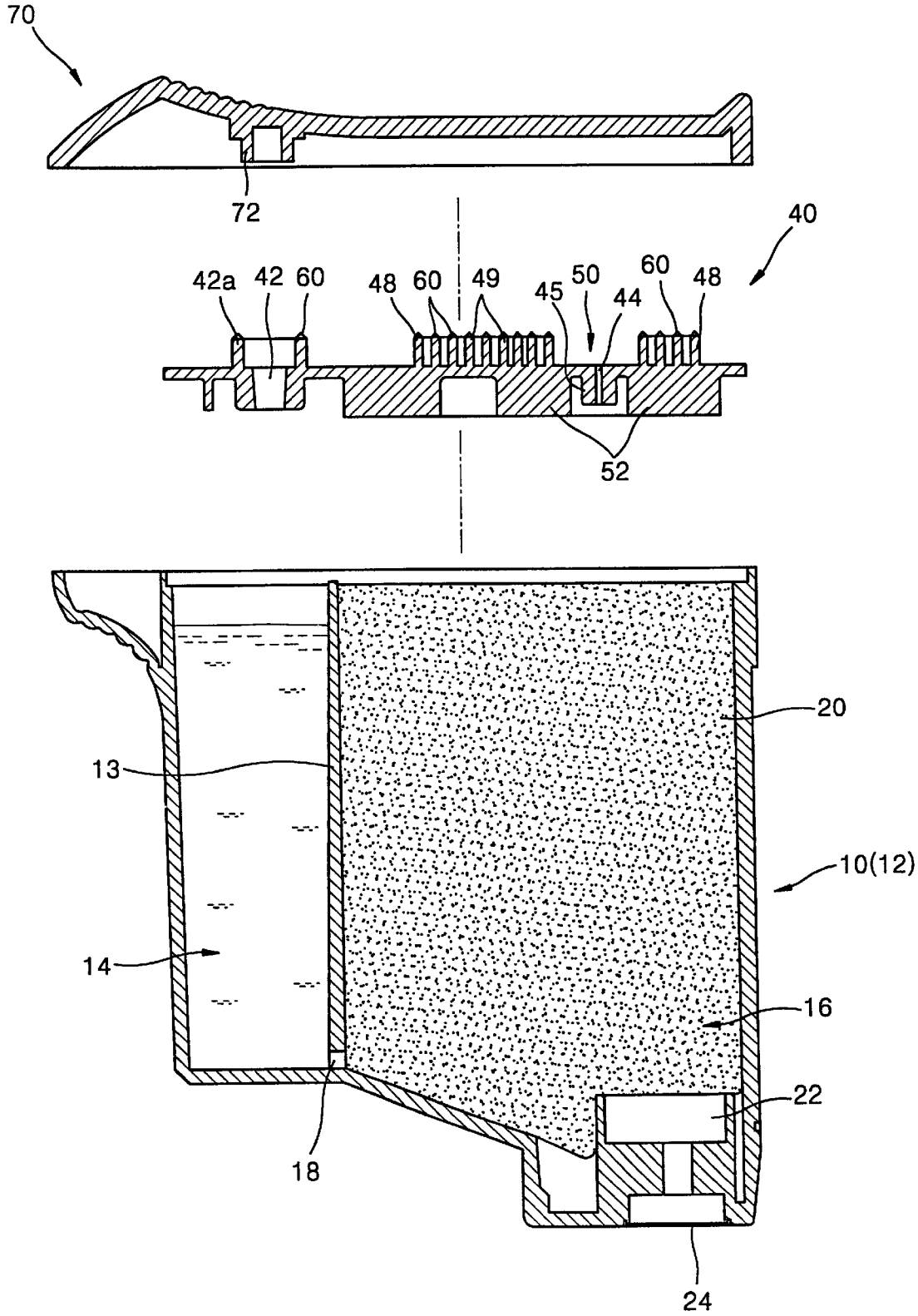
FIG. 4 is an exploded cross-sectional view of the ink cartridge of FIG. 2.

FIG. 4 is an exploded cross-sectional view of the ink cartridge of FIG. 2 before all components are fused ultrasonically to be combined with one another. Referring to FIG. 4, triangle-shaped fusing guides 60 are formed on the surface of the inner cover 40 to be easily fused with the outer cover 70. When all components are fused to be combined with one another, the fusing guides 60 are melted on the corresponding surface of the outer cover 70, thus sealing up connections between the inner cover 40 and the outer cover 70. After ink is filled through the ink filling hole 42 on the inner cover 40, a cylindrical element 72 formed on the outer cover 70 is fitted in the cylindrical element 42*a* encircling the ink filling hole 42, thereby sealing up the ink filling hole 42.

In the operation of the ink cartridge having the above structure with reference to FIGS. 2 through 4, the ink storage chamber 10 is ultrasonically fused with the inner cover 40, and then ink is filled through the ink filling hole 42 of each of the first chambers 14, which contain the respective colored ink. Once each of the ink storage chambers 12 is completely filled with ink, the outer cover 70 is fused with the upper portion of the inner cover 40. When the completed ink cartridge 1 is attached to a printer, the stored ink is supplied to the head 24 via the ink supply pipe 22 below the second chamber 16. As a result, the ink contained in the second chamber 16 is discharged from pores of the sponge 20 in the second chamber 16 and is used. At this time, the pressure inside the second chamber 16 drops below the atmospheric pressure and air enters the air chamber 46 via the hole 46*a*. The air entering the air chamber 46 is filtered to remove dust and other impurities by passing through the air passage 49*a*. Then, the filtered air enters the air discharging hole 44 to increase the pressure inside the second chamber 16, thereby preventing the pressure from dropping too low and obstructing the smooth discharge of ink. Further, the ink contained in the first chamber 14 flows into the second chamber 16 via the ink passage 18 due to capillary attraction of the sponge 20.

In the ink cartridge 1 shown in FIG. 2, the ink contained in each of the chambers does not leak when the ink cartridge 1 is turned upside-down because the ink filling hole 42 into which ink is filled into is sealed up. Ink contained in the second chamber 16 may leak through the air discharging hole 44 if the height of the ink exceeds the predetermined height of the cylindrical element 45 encircling the air discharging hole 44. However, even if ink leaks from the air discharging hole 44, most of the ink that leaks is stored in an ink storage space 50 and the air passage 49*a* between the plates 49, and thus an air passage 49*a* does not get clogged by the ink unlike in conventional ink cartridges. Also, when the ink cartridge 1 is placed back in the regular position, ink that leaked from the ink storage chamber 12 into the air passage 49*a* and the ink storage space 50 flows back to the second chamber 16 via the air discharging hole 44. Even if some ink remains at the bottom of the air chamber 46, the remaining ink does not block air passages 49*a*.

Although in this embodiment, a three colored ink cartridge has been particularly described, an ink cartridge according to another embodiment of the present invention can be used only with one color ink. A detailed description thereof will be omitted.

As described above, in an ink cartridge according to the present invention, it is possible to satisfactorily suppress the backward flow of ink contained in an ink storage chamber due to the overheating of or careless treatment of the ink cartridge. Even if ink flows backward from the ink storage chamber, it is stored in an ink storage space, thus preventing the clogging of an air passage. Further, air entering the ink storage space is filtered, passing through the air passage, and additional components are not required to seal up an opening to which ink is supplied. For this reason, manufacturing cost can be reduced and a manufacturing process can be simplified.

Although a few preferred embodiments of the present invention have been shown and described, it will be appreciated by those skilled in the art that changes may be made in these embodiments without departing from the principles and spirit of the invention, the scope of which is defined in the claims and the equivalents.

What is claimed is:

1. An ink cartridge including an ink storage chamber in which ink is stored, a cover to cover the upper portion of the ink storage chamber, and a head to eject ink droplets in the ink storage chamber onto a recording medium, wherein the cover comprises:

an inner cover to cover the upper portion of the ink storage chamber having an air discharging hole;

an outer cover to seal the ink storage chamber and the inner cover, the outer cover positioned at a predetermined distance above the inner cover, and crisscrossing plates, between the inner cover and the outer cover, to form zigzag air passages by blocking a space between the inner cover and the outer cover, wherein the air discharging hole is connected to the air passages.

2. The ink cartridge according to claim 1, wherein the inner cover comprises:

an ink filling hole through which ink is filled into the ink storage chamber.

3. The ink cartridge according to claim 1, further comprising a cylindrical element extending from the lower part of the inner cover and having a predetermined height to encircle said air discharging hole.

4. The ink cartridge according to claim 2, wherein the ink filling hole is sealed by combining a first cylindrical element, which is formed on the inner cover encircling the ink filling hole, and a second cylindrical element formed on the outer cover to be engaged with the first cylindrical element.

5. The ink cartridge according to claim 1, wherein the inner cover and the outer cover are ultrasonically fused to be combined with each other.

6. An ink cartridge ejecting a plurality of colors of ink including ink storage chambers to contain a different color of ink, respectively, a cover to cover the upper portion of the ink storage chambers, and heads to eject a plurality of colors of ink droplets in the ink storage chambers onto a recording medium, wherein the cover comprises:

an inner cover to cover the upper portion of the ink storage chambers having an air discharging hole associated with each ink storage chamber;

an outer cover to seal the ink storage chambers and the inner cover, the outer cover positioned at a predetermined distance above the inner cover; and crisscrossing plates, between the inner cover and the outer cover, to form zigzag air passages by blocking a space between the inner cover and the outer cover, wherein the air discharging hole is connected to the air passages.

7. The ink cartridge according to claim 6, wherein the inner cover comprises:

an ink filling hole associated with each ink storage chamber through which ink is filled into the ink storage chamber.

8. The ink cartridge according to claim 6, further comprising a cylindrical element extending from the lower part of the inner cover and having a predetermined height to encircle each said air discharging hole.

9. The ink cartridge according to claim 7, wherein each of the ink filling holes is sealed by combining a first cylindrical element, which is formed on the inner cover encircling the ink filling hole, and a second cylindrical element formed on the outer cover to be en aged with the first cylindrical element.

10. The ink cartridge according to claim 6, wherein the inner cover and the outer cover are ultrasonically fused to be combined With each other.

11. An ink cartridge including an ink storage chamber in which ink is stored, a cover to cover the upper portion of the ink storage chamber, and a head to eject ink droplets in the ink storage chamber onto a recording medium, wherein the cover comprises:

an inner cover to cover the upper portion of the ink storage chamber having an ink filling hole through which ink is filled into the ink storage chamber;

an outer cover to seal the ink storage chamber and the inner cover, the outer cover positioned at a distance above the inner cover; and plates to form zigzag air passages by blocking a space between the inner cover and the outer cover, wherein the ink filling hole is sealed by combining a cylindrical element which is formed on the inner cover and encircling the ink filling hole and a second cylindrical element formed on the outer cover to be engaged with the first cylindrical element.

12. The ink cartridge according to claim 11, wherein the inner cover comprises an air discharging hole connected to the air passages at an upper portion thereof.

13. The ink cartridge according to claim 11, wherein the inner cover and the outer cover are ultrasonically fused to be combined with each other.

14. An ink cartridge ejecting a plurality of colors of ink including ink storage chambers to contain different colors of ink, respectively, a cover to cover the upper portion of the ink storage chambers, and heads to eject a plurality of colors of ink droplets in the ink storage chambers onto a recording medium, wherein the cover comprises:

an inner cover to cover the upper portion of the ink storage chambers having an ink filling hole associated with each ink storage chamber through which ink is filled into the ink storage chamber;

an outer cover to seal the ink storage chambers and the inner cover, the outer cover positioned at a distance above the inner cover; and plates to form zigzag air passages by blocking a space between the inner cover and the outer cover, wherein the ink filling holes are sealed by combining a first cylindrical element which is formed on the inner cover and encircling the ink filling hole and a second cylindrical element formed on the outer cover to be engaged with the first cylindrical element.

15. The ink cartridge according to claim 14, wherein the inner cover comprises an air discharging hole associated with each ink storage chamber connected to the air passages at upper portions thereof.

16. The ink cartridge according to claim 14, wherein the inner cover and the outer cover are ultrasonically fused to be combined with each other.

* * * * *